US005873745A

United States Patent [19]

Duclos et al.

[11] Patent Number: 5,873,745

[45] Date of Patent: Feb. 23, 1999

[54] DEVICE FOR COUPLING TWO ELECTRICAL CONNECTOR HOUSING MEMBERS

[75] Inventors: Jean-Louis Duclos, Elancourt; Jean Ittah, Villeneuve la Garenne; David Rognerud, Vaux sur Seine, all of France

[73] Assignee: Connecteurs Cinch, Montigny le Bretonneux, France

[ * ] Notice: Notice: Under 35 U.S.C. 154(b), the term of this patent shall be extended for 137 days.

[21] Appl. No.: 754,648

[22] Filed: Nov. 21, 1996

Related U.S. Application Data

[63] Continuation of Ser. No. 397,876, Mar. 2, 1995, abandoned.

[30] Foreign Application Priority Data

Mar. 21, 1994 [FR] France ..... 94 03283

[51] Int. Cl.[6] ..... H01R 13/62

[52] U.S. Cl. ..... 439/157; 439/372

[58] Field of Search ..... 439/152–160, 439/372

[56] References Cited

U.S. PATENT DOCUMENTS

| | | | |
|---|---|---|---|
| 4,487,467 | 12/1984 | Guerrero et al. . | |
| 4,893,405 | 1/1990 | Pennington | 439/160 |
| 5,322,448 | 6/1994 | Hahn | 439/157 |
| 5,344,194 | 9/1994 | Hatagishi et al. | 439/157 |
| 5,564,935 | 10/1996 | Yagi et al. | 439/157 |

FOREIGN PATENT DOCUMENTS

| | | |
|---|---|---|
| 0060187 | 9/1982 | European Pat. Off. . |
| 0273999 | 7/1993 | European Pat. Off. . |
| 0587174 | 3/1994 | European Pat. Off. . |
| 8703196 | 8/1988 | Germany . |

OTHER PUBLICATIONS

French Search Report and Annex.

*Primary Examiner*—Paula Bradley
*Assistant Examiner*—Tho Dac Ta
*Attorney, Agent, or Firm*—Greenblum & Bernstein, P.L.C.

[57] ABSTRACT

Device for coupling two electrical connector housing members includes two toothed sectors on one member, each sector including a slot leading to a cam. The cams cooperate with two lugs on the other member. The sectors are rotated to occupy either an open first position or a locked second position.

17 Claims, 5 Drawing Sheets

DEVICE FOR COUPLING TWO ELECTRICAL CONNECTOR HOUSING MEMBERS

This application is a continuation, of application Ser. No. 08/397,876, filed Mar. 2, 1995, now abandoned.

BACKGROUND OF THE INVENTION

1. Field of the Invention

The invention concerns a device for coupling two electrical connector housing members.

2. Description of the Prior Art

The invention is more particularly concerned with connector housings, such as computer connector housings, for example, having a female member with male tongues upstanding from the bottom and a male member having female members adapted to receive the tongues. In computers there is usually a large number of connections and the tongues are always somewhat fragile. The insertion of the members must therefore be carried out in a constant direction with only low insertion forces.

One object of the present invention is to provide a device which meets these requirements.

SUMMARY OF THE INVENTION

The invention consists in a device for coupling two electrical connector housing members of generally parallelepiped shape comprising a female member adapted to receive a male member wherein one member has on each of two opposite sides two lugs and the other member has, pivoting on each of two corresponding opposite sides two toothed sectors, each sector has a slot leading to a cam, each cam is adapted to cooperate with a corresponding lug and means are mounted on the member including the toothed sectors to rotate the latter in one direction to an open first position and in the opposite direction to a locked second position.

In accordance with one feature of the invention, the means for rotating the toothed sectors comprise a lever fastened to one sector, the sectors mesh with each other and the cams of the sectors are symmetrical to a median plane perpendicular to a plane passing through the pivot axes of the sectors.

In one embodiment of the invention, the device has on each of two opposite sides a gear inserted between the sectors and means for selectively rotating the gears in one direction corresponding to the open first position and in the opposite direction corresponding to the locked second position.

In accordance with one constructive feature of the invention, the means for rotating the gears comprise a lever having two branches each fastened to the corresponding gear.

In another embodiment of the invention, the means for rotating the gears comprise a stirrup member sliding on the housing member including the sectors and including racks cooperating with the gears.

In accordance with another feature of the invention, the device includes means for locking the stirrup member to the corresponding housing member in two opposite extreme positions one of which corresponds to the open first position and the other to the locked second position.

Finally, in accordance with one constructive feature of the invention, the member including the lever also includes an elastic hook adapted to cooperate with the lever to lock it in the locked position.

The member including the lever also includes abutments to limit pivoting of the lever towards the open position and means for holding the lever in the open position.

The invention will now be described in more detail with reference to specific embodiments of the invention shown by way of example only in the appended drawings.

DETAILED DESCRIPTION OF THE PREFERRED EMBODIMENTS

Figure 1:
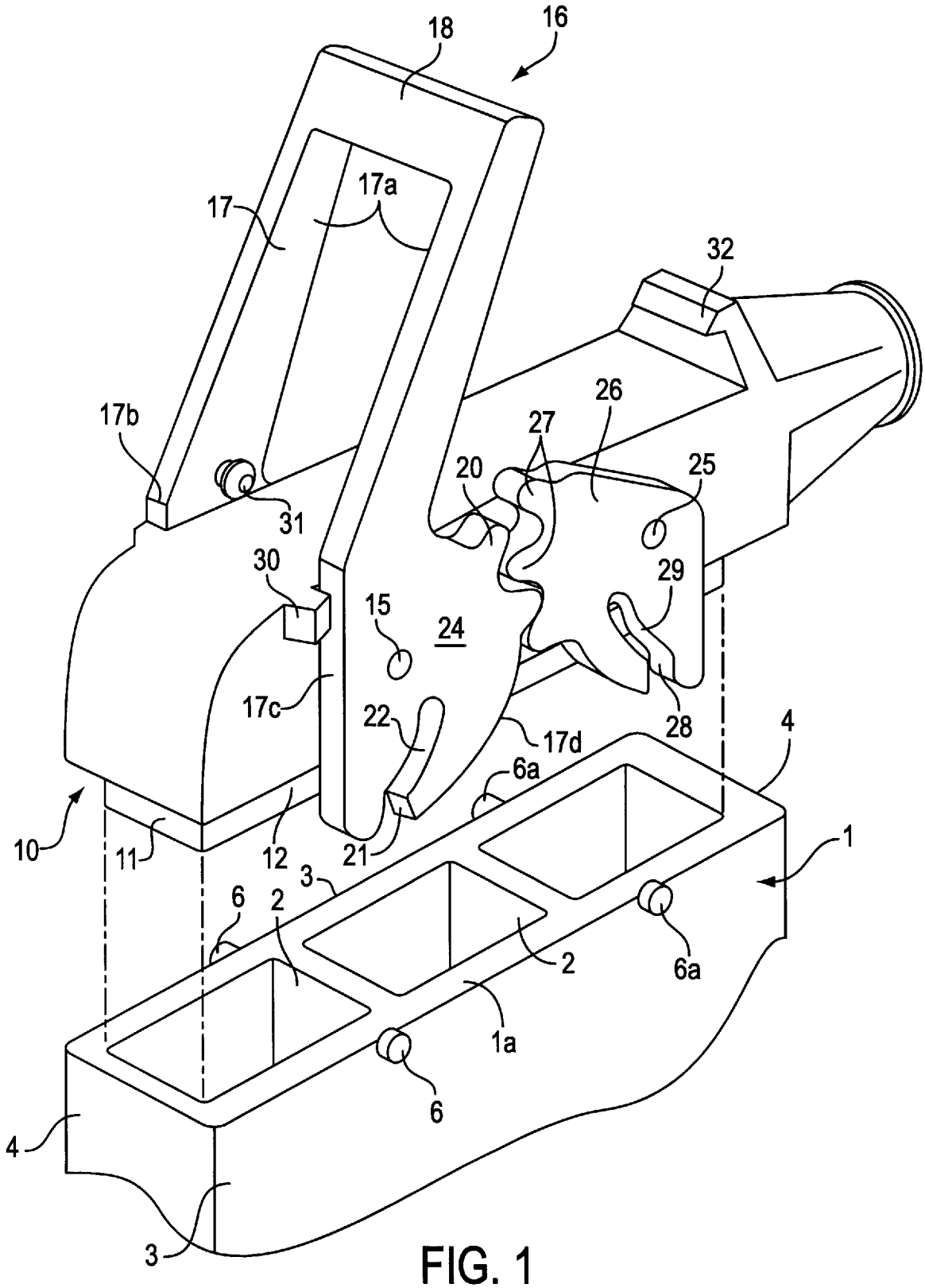
FIG. 1 is an exploded perspective view of a connector including a coupling device in accordance with the invention.
Figure 2:
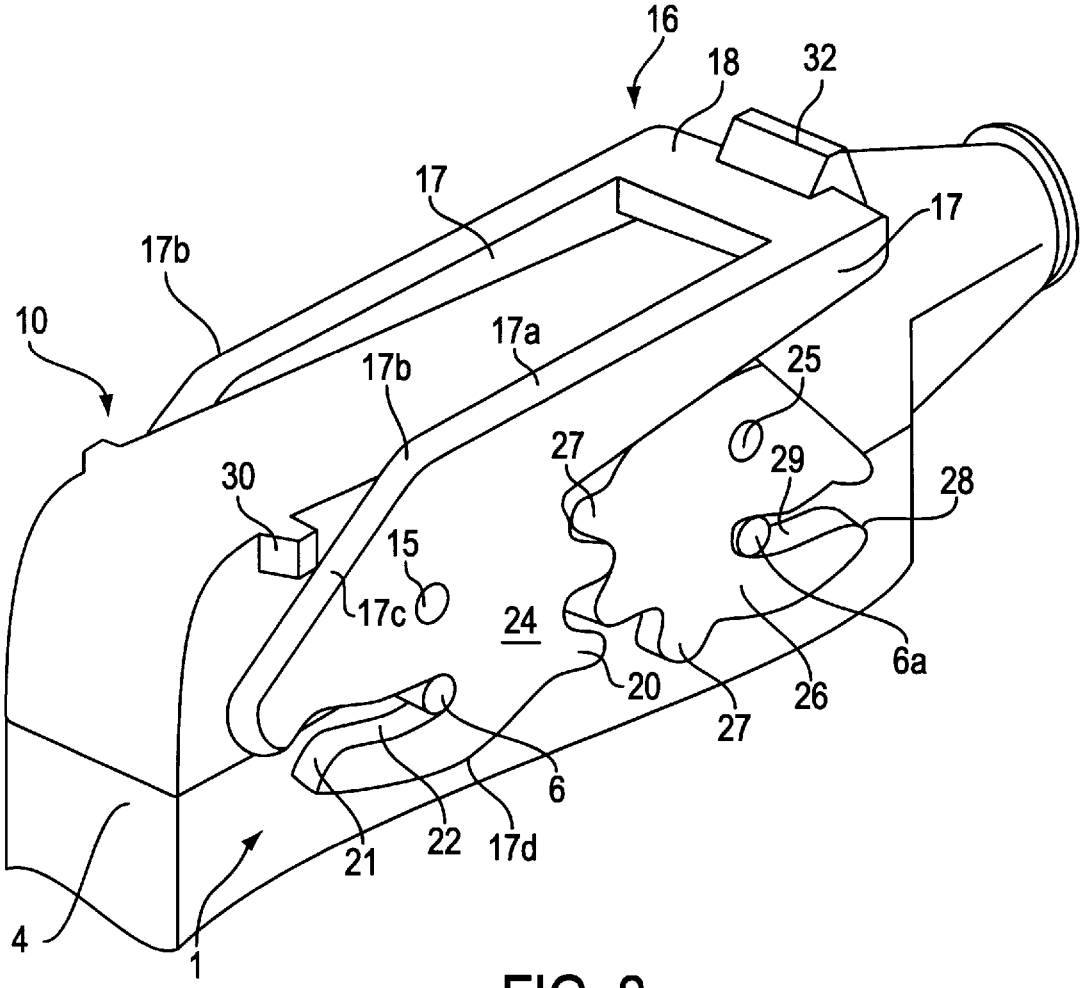
FIG. 2 is a perspective view showing the connector locked.

FIGS. 1 and 2 show a generally parallepiped shape female housing member 1 which has two longitudinal walls 3 and two end walls 4.

The member 1 includes three compartments 2 and has two lugs 6 and 6*a* on its side walls 3, near one end 1*a*.

The housing member 1 is adapted to receive a complementary housing member 10 which has parts 11 adapted to be inserted into the compartments 2 and which are connected to the member 10 by a shoulder 12 adapted to bear against the end 1*a*.

The parts 11 can be an integral part of the member 10 or in the form of receptacles inserted into the housings of the member.

The bottom of each compartment 2 contain a series of tongues connected to electrical circuits while the parts 11 contain a series of female members connected to electrical circuits and adapted to cooperate with the tongues. These well-known members are not shown here.

A U-shape lever 16 with two branches 17 and a center section 18 which constitutes the handle for operating it pivots on a spindle 15 of the member 10.

Along one edge 17*a* each branch 17 forms an elbow 17*b* joined to a part 17*c*. Along the edge opposite the edge 17*a* the free end of each branch 17 forms a sector 24 with two teeth 20.

The teeth 20 are located on a circular arc concentric with the spindle 15.

The end of the sector 24 adjacent the part 17*c* includes a slot 21 leading to a cam 22 constituted by an arcuate groove extending towards the spindle 15 from the slot 21.

Sectors 26 pivot on spindles 25 parallel to the spindle 15 on each side of the member 10. They have teeth 27 which mesh with the teeth 20 and are disposed on an arc concentric with the spindle 25.

The sector 26 includes a slot 28 opening onto its lateral edge and leading to a cam 29 constituted by an arcuate groove extending towards the spindle 25 from its end adjacent the slot 28.

The cams 22 and 29 are symmetrical to a plane intersecting the plane passing through the spindles 15 and 25 at a median intermediate point.

The member 10 has abutments 30 which limit tilting of the lever 16 in an opening direction, the inside surfaces of the branches 17 having a boss 31 to hold the lever 16 in the open position.

The member 10 has a hook adapted to cooperate with the lateral surface of the center section 18 to lock the lever 16 in the closed position, by virtue of slight elastic deformation of said hook 32.

The device of the invention finds a particularly beneficial application in computer connector housings which include a large number of male tongues adapted to cooperate with a large number of female contact members, so that the insertion of the male member into the female member must be accomplished strictly parallel to the axes of the tongues to avoid any deformation of the latter.

As shown in FIG. 1, the member 10 is offered up with the lever 16 in the open position so that the lugs 6 and 6*a* enter the respective slots 21 and 28. The lever 16 is then pivoted about the spindle 15 towards the closed and locked position, cooperating with the hook 32.

During this pivoting the teeth 20 mesh with the teeth 27 of the sector 26 and displace them so that the cams 22 and 29, as they tilt and cooperate with the lugs 6 and 6*a*, command insertion of the parts 11 into the compartments 2.

The reverse procedure is used to uncouple the members 1 and 10.

In the embodiment described, the lever 16 and the sectors are carried by the male part 10, the lugs 6, 6*a* being on the female part 1; however, the coupling device of the invention could equally well be implemented with the lever and the sector on the member 1 and the lugs on the member 10.

Figure 3:
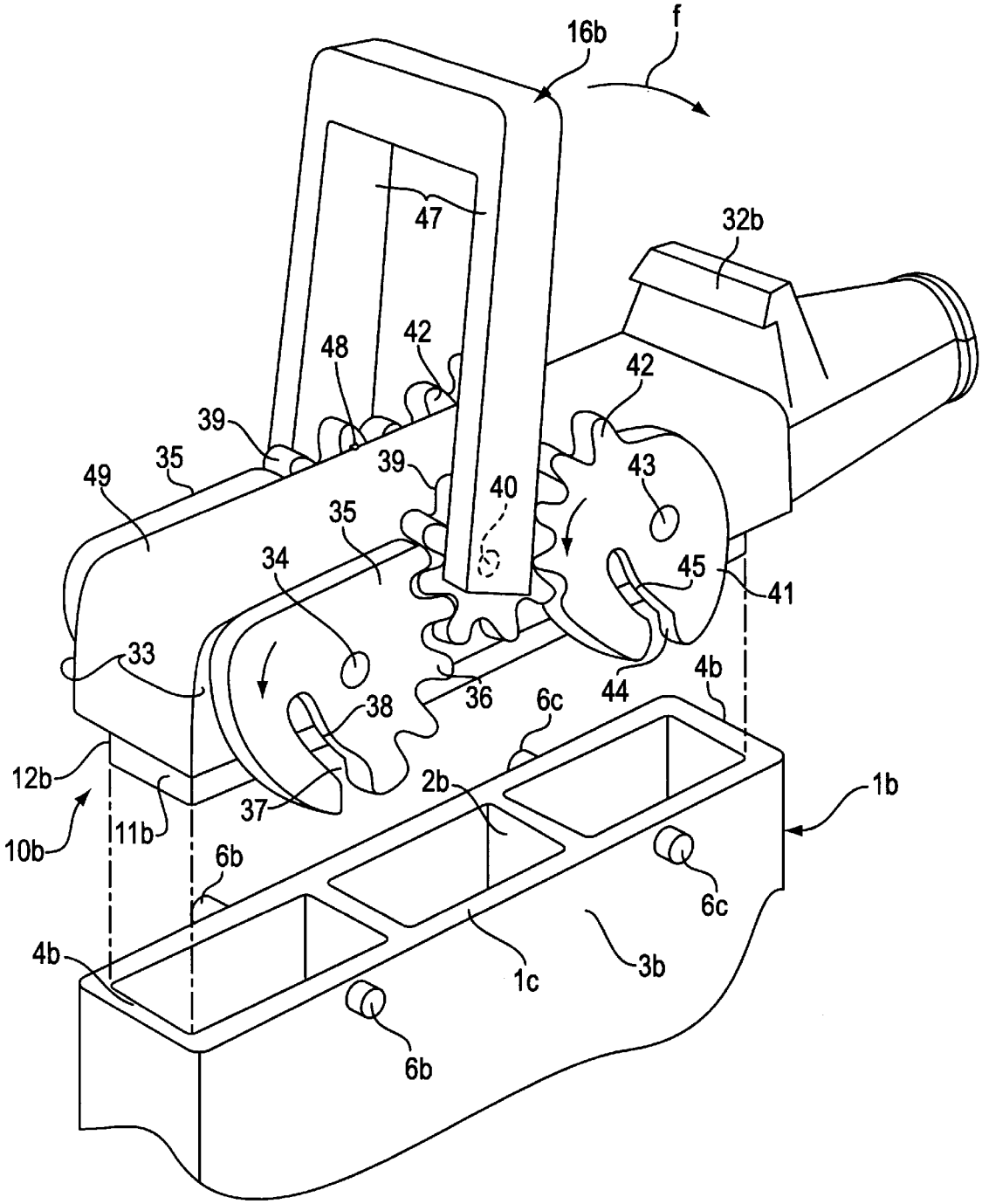
FIG. 3 is an exploded perspective view of the connector including one embodiment of the coupling device.
Figure 4:
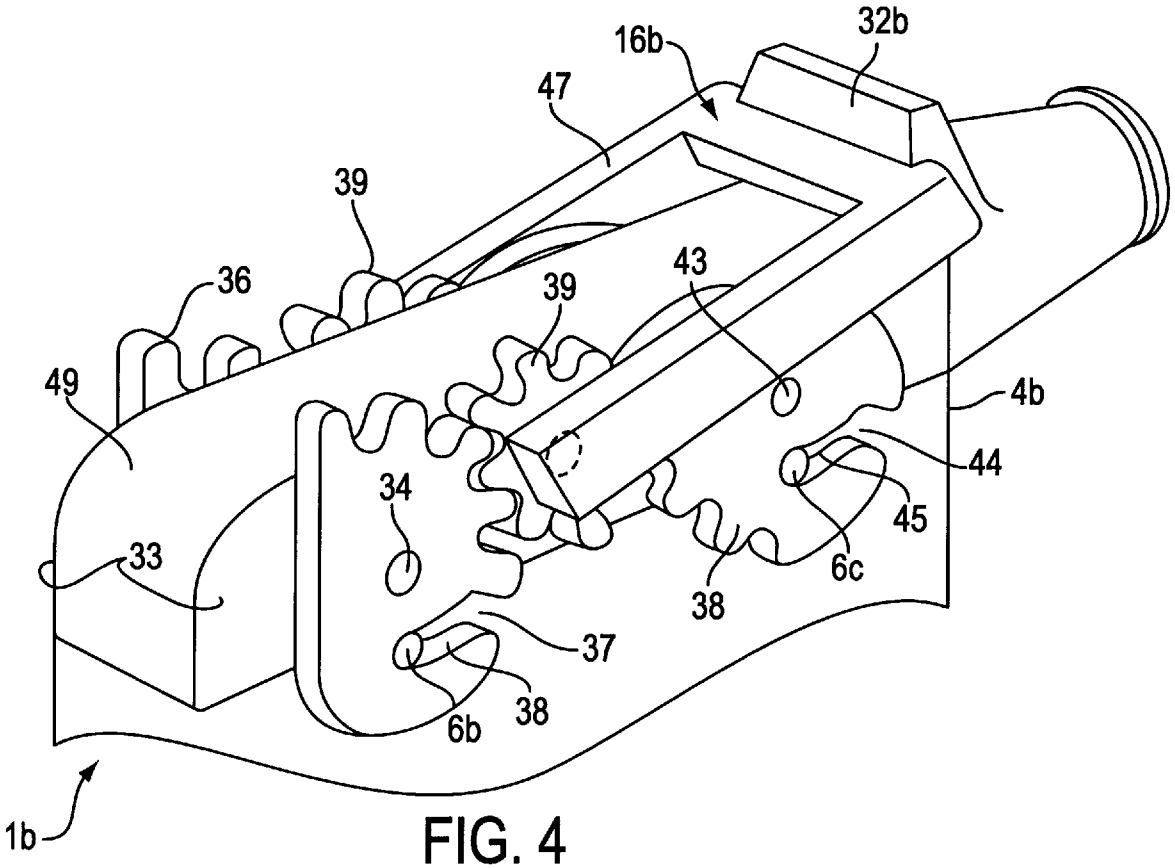
FIG. 4 is a view showing the connector from FIG. 3 locked.

FIGS. 3 and 4 show a second embodiment of the invention.

In these figures the same reference numbers with the suffix "b" are used to identify parts corresponding to those of the previous figures.

The female housing member 1*b* is identical to that shown in the previous figures and will not be described in detail.

The complementary housing member 10*b* has parts 11*b* adapted to be inserted into the compartments 2*b* and joined to said member 10*b* by a shoulder 12*b* adapted to bear against the corresponding end 1*c* of the female member 1*b*.

On each of two opposite sides 33 the member 10*b* has a spindle 34 on which pivots a sector 35 having teeth 36 and a slot 37 leading to a cam 38.

The teeth 36 mesh with an idler gear 39 on a spindle 40 on each wall 33.

The gear 39 cooperates with the teeth 42 of the second sector 41 which pivots freely on a spindle 43 and has a slot 44 leading to a cam 45.

Each gear 39 is attached to one end of a branch 47 of a lever 16*b* which in the locked position cooperates with a hook 32*b*.

The gears 39 can have on the side facing towards the side surfaces 33 a boss 48 which cooperates with the edge of one side 49 to hold the lever 16*b* in the open position.

When the lever 16*b* is in the open position (see FIG. 3) and the parts 11*b* are engaged in the compartments 2*b* the lugs 6*b* are inserted in the slots 37 and the lugs 6*c* are inserted in the slots 44.

When the lever 16*b* is pushed down in the direction of the arrow f the gears 39 rotate the sectors 35 and 41 so that the lugs 6*b* and 6*c* cooperate with the cams 38 and 45, respectively, to effect coupling in the contact insertion direction.

Figure 5:
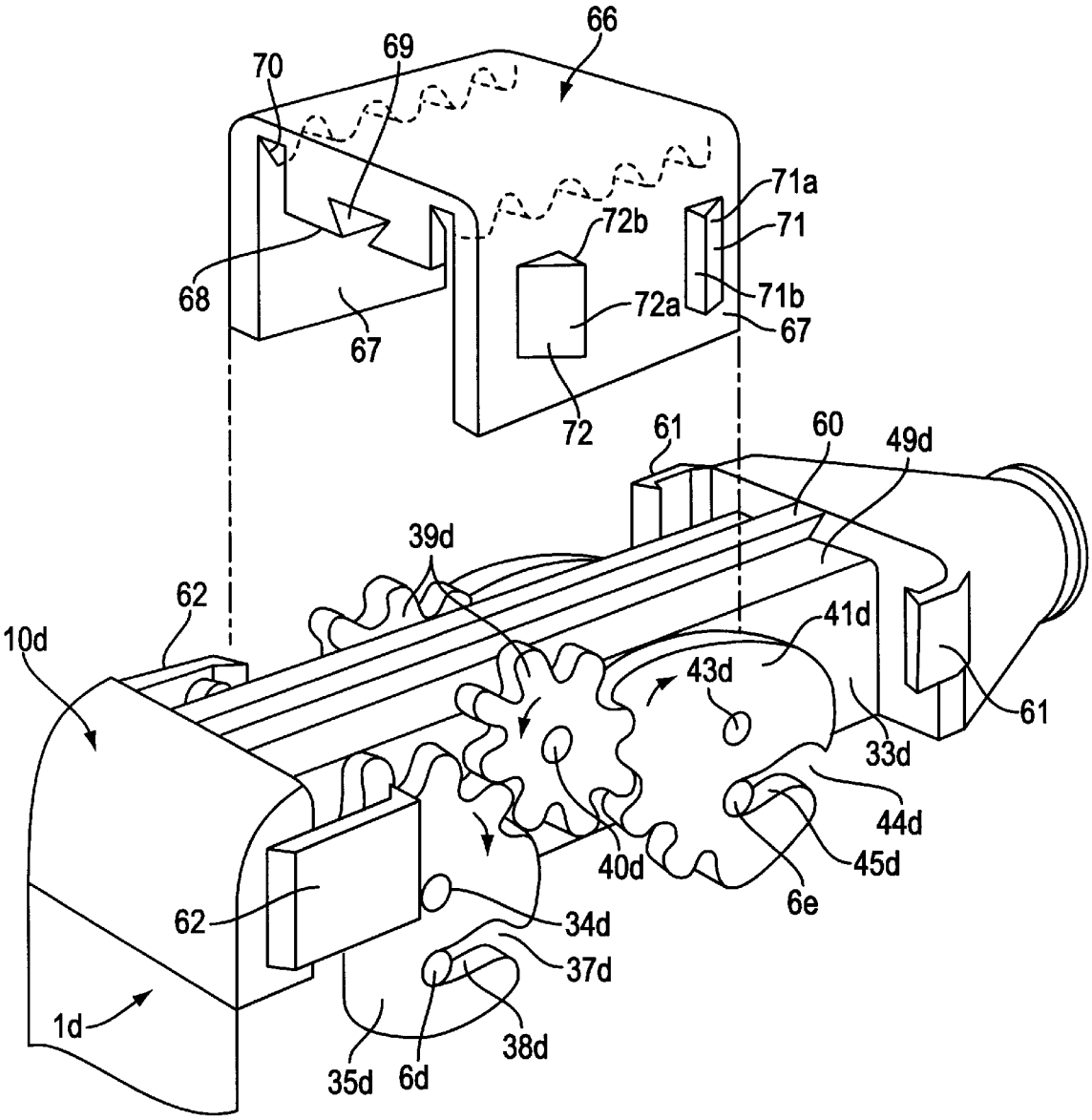
FIG. 5 is an exploded perspective view of a third embodiment of the invention.

FIG. 5 shows a variant of FIGS. 3 and 4. This figure uses the same reference numbers with the suffix "d" to identify parts corresponding to those in FIGS. 3 and 4.

In this embodiment the side 49*d* has a projecting strip 60 with a dovetail cross-section.

At one end the member 10*d* has a hook 61 facing each side 33*d*. At the other end it has hooks 62.

A U-section stirrup member 66 has two branches 67 and a center section 68. The latter has on its inside surface a dovetail cross-section groove 69 matching the strip 60.

The center section 68 has along the inside of each branch 67 a rack 70 adapted to cooperate with a corresponding gear 39*d*.

On the outside of each branch 67 there are a first abutment 71 having a ramp side 71*a* and a steep side 71*b* and a second abutment 72 having a ramp side 72*a* and a steep side 72*b*. The steep sides 71*b* and 72*b* face each other.

The stirrup member 66 slides on the member 10*d*, its groove 69 cooperating with the strip 60.

The stirrup member 66 is mounted on the member 10*d* so that when the abutments 71 cooperate with the hooks 61 it occupies the closed and locked position and when it is slid so that the abutments 72 are locked by the hooks 62 the gears 39*d* are driven by the rack 70 and move the sectors 35*d* and 41*d* into the unlocked position.

Of course, the invention is not limited to the embodiments described and shown. Many modifications of detail can be made thereto without departing from the scope of the invention.

There is claimed:

1. A device for coupling two electrical connector housing members of generally parallelpiped shape, comprising:

a male member including two opposite sides;

a female member including two opposite sides adapted to receive said male member;

two lugs positioned on each of said two opposite sides of one of said male member or said female member;

four toothed sectors pivotally mounted on the other of said male member and said female member, two toothed sectors of said four toothed sectors being pivotally mounted on two axes positioned on each of two corresponding opposite sides of the other of said male member and said female member, said two toothed sectors meshing with each other on each of the two opposite sides;

each of said two toothed sectors including a slot leading to a cam, each cam being adapted to cooperate with a corresponding lug, and each cam being symmetrical with respect to a median plane perpendicular to a plane passing through said two axes throughout activation of the device; and a U-shaped lever comprising two arms, each of said two arms being fastened to one of said two toothed sectors on each of the two opposite sides.

2. The coupling device according to claim 1, comprising a locking element capable of locking said lever on said other of said male member and said female member in two opposite extreme positions, one of said two positions comprising an open position wherein said lever projects from said other of said male member and said female member, and the other of said two positions comprising a locked position.

3. The coupling device according to claim 2, wherein in said locked position said lever is positioned adjacent a side of said other of said male member and said female member.

4. The coupling device according to claim 3, wherein said locking element comprises an elastic hook on said other of said male member and said female member adapted to cooperate with said lever to lock said lever in said locked position.

5. The coupling device according to claim 4, wherein said locking element further comprises abutments on said other of said male member and said female member to limit pivoting of said lever towards said open position.

6. The coupling device according to claim 5, wherein said locking element further comprises a boss adapted to cooperate with one of the two opposite sides of said other of said male member and said female member to maintain said lever in the open position, said boss being positioned on an internal side of one of said two arms.

7. A device for coupling two electrical connector housing members of generally parallelpiped shape, comprising:

a male member including two opposite sides;

a female member including two opposite sides adapted to receive said male member;

two lugs positioned on each of said two opposite sides of one of said male member or said female member;

four toothed sectors pivotally mounted on the other of said male member and said female member, two toothed sectors of said four toothed sectors being pivotally mounted on two axes positioned on each of two corresponding opposite sides of the other of said male member and said female member, said two toothed sectors meshing with each other on each of the two opposite sides;

each of said two toothed sectors including a slot leading to a cam, each cam being adapted to cooperate with a corresponding lug, and each cam being symmetrical with respect to a median plane perpendicular to a plane passing through said two axes throughout activation of the device; and a lever for rotating said toothed sectors in one direction to an open position and in an opposite direction to a locked position.

8. Device for coupling two electrical connector housing members, comprising:

a male member including two opposite sides;

a female member including two opposite sides adapted to receive said male member;

two lugs positioned on each of said two opposite sides of one of said male member and said female member;

four toothed sectors pivotally mounted on the other of said male member and said female member, two toothed sectors of said four toothed sectors being pivotally positioned on each of two corresponding opposite sides of the other of said male member and said female member;

a gear inserted between said two toothed sectors on each of said two corresponding opposite sides;

each of said two toothed sectors including a slot leading to a cam, each cam being adapted to cooperate with a corresponding lug;

an element capable of rotating each gear in one direction to an open position and in an opposite direction to a locked position.

9. The device according to claim 8, wherein said element capable of rotating each gear comprises a lever comprising two branches, each of said two branches fastened to a corresponding gear.

10. The device according to claim 9, wherein said other of said male member and said female member includes an elastic hook adapted to cooperate with said lever to lock said lever in said locked position.

11. The device according to claim 8, wherein said element capable of rotating each gear comprises a stirrup member, said stirrup member being slidably positioned on said other of said male member and said female member, and said stirrup includes racks cooperating with each gear.

12. The device according to claim 11, further comprising a locking member which locks said stirrup member to said other of said male member and said female member in two opposite extreme positions, one of said two opposite extreme positions corresponding to said open position and the other of said two opposite extreme positions corresponding to said locked position.

13. Device for coupling two electrical connector housing members, comprising:

a male member including two opposite sides;

a female member including two opposite sides adapted to receive said male member;

each of said male member and said female member comprising a generally parallelpiped shape;

two lugs positioned on each of said two opposite sides of one of said male member and said female member;

four toothed sectors pivotally mounted on the other of said male member and said female member, two toothed sectors of said four toothed sectors being pivotally positioned on each of two corresponding opposite sides of the other of said male member and said female member;

a gear inserted between said two toothed sectors on each of said two corresponding opposite sides;

each of said two toothed sectors including a slot leading to a cam, each cam being adapted to cooperate with a corresponding lug; and an element capable of rotating each gear in one direction to an open position and in an opposite direction to a locked position.

14. The device according to claim 13, wherein said element capable of rotating each gear comprises a lever comprising two branches, each of said two branches fastened to a corresponding gear.

15. The device according to claim 14, wherein said other of said male member and said female member includes an elastic hook adapted to cooperate with said lever to lock said lever in said locked position.

16. The device according to claim 13, wherein said element capable of rotating each gear comprises a stirrup member, said stirrup member being slidably positioned on said other of said male member and said female member, and said stirrup includes racks cooperating with each gear.

17. The device according to claim 16, further comprising a locking member which locks said stirrup member to said other of said male member and said female member in two opposite extreme positions, one of said two opposite extreme positions corresponding to said open position and the other of said two opposite extreme positions corresponding to said locked position.

* * * * *